US007404542B2

(12) United States Patent
Smith et al.

(10) Patent No.: US 7,404,542 B2
(45) Date of Patent: Jul. 29, 2008

(54) VALVE FOR A FLEXIBLE CONTAINER

(75) Inventors: Mark Smith, Plainfield, IL (US); Michael L. Wilford, Chicago, IL (US)

(73) Assignee: Rapak, LLC, Romeoville, IL (US)

( * ) Notice: Subject to any disclaimer, the term of this patent is extended or adjusted under 35 U.S.C. 154(b) by 0 days.

(21) Appl. No.: 11/056,411

(22) Filed: Feb. 11, 2005

(65) Prior Publication Data

US 2005/0211730 A1 Sep. 29, 2005

Related U.S. Application Data

(60) Provisional application No. 60/544,867, filed on Feb. 13, 2004.

(51) Int. Cl.
*F16K 51/00* (2006.01)

(52) U.S. Cl. ..... 251/144; 251/153; 222/518

(58) Field of Classification Search ..... 251/82, 251/83, 144, 148, 151, 153; 222/105, 107, 222/518
See application file for complete search history.

(56) References Cited

U.S. PATENT DOCUMENTS

| | | | | |
|---|---|---|---|---|
| 4,452,425 | A * | 6/1984 | Lucking | 251/144 |
| 4,515,294 | A | 5/1985 | Udall | |
| 4,865,233 | A | 9/1989 | Kain | |
| 5,062,552 | A | 11/1991 | Heubel | |
| 5,071,042 | A | 12/1991 | Esposito | |
| 5,156,300 | A | 10/1992 | Spahni et al. | |
| 5,390,814 | A | 2/1995 | Christine et al. | |
| 5,556,005 | A | 9/1996 | Banks | |
| 6,561,386 | B1 | 5/2003 | Martens | |
| 6,883,683 | B1 * | 4/2005 | Cunningham et al. | 222/107 |

* cited by examiner

*Primary Examiner*—John K Fristoe, Jr.
(74) *Attorney, Agent, or Firm*—Joseph A. Fuchs; Rockey, Depke & Lyons, LLC

(57) ABSTRACT

The present invention relates generally to a valve for a flexible plastic container and more particularly to a valve for dispensing particulate containing liquids.

5 Claims, 2 Drawing Sheets

VALVE FOR A FLEXIBLE CONTAINER

CROSS-REFERENCE TO RELATED APPLICATIONS

This application claims the benefit of U.S. Provisional application Ser. No. 60/554,867, filed Feb. 13, 2004, and whose entire contents are hereby incorporated by reference.

FEDERALLY SPONSORED RESEARCH OR DEVELOPMENT

Not Applicable.

BACKGROUND OF THE INVENTION

Technical Field

The present invention relates generally to a valve for a flexible plastic container and more particularly to a valve for dispensing particulate containing liquids.

Collapsible plastic bags are often used to store liquid products such as chemicals, soft drink syrup, fruit juices and food condiments. The plastic bags are typically housed in a corrugated paperboard box to aid in the transporting, handling and dispensing of the product. Such packaging systems are commonly referred to as "bag-in-box" packaging systems.

The plastic bags typically have sidewalls sealed along a peripheral seam to define a fluid containing chamber. An access member associated with the bag provides fluid communication with the contents of the bag. The access member can be an assembly of a fitment and a valve for example. The valve may be alternately opened and closed in order to permit fluid to exit from the bag for consumption purposes.

The advantage that such containers have over other older prior art containers is the fact that the fluid contained within the bag will stay fresher for much longer periods of time and therefore from the standpoint of shelf life, the product has an extended shelf life. Furthermore, such assemblies do not require that airholes be included in the container in order to permit the fluid to flow and exit from the container into the consumer's vessel.

Juice machines described herein are used to dispense juice contained in a bag in box system. Juice machines are usually designed to accommodate a plurality of plastic container bag-in-box cartridges which are positioned within the machine in a vertical orientation so that the machine is designed to dispense any one of a number of juices. It is well-known that juice bars and other similar types of establishments contain juice machines which are designed to dispense a plurality of juices from each machine including orange juice, pineapple juice, grape juice and the like. In such applications, the plastic containers are designed to be filled with a juice, then frozen until the same are ordered and delivered to the end destination. The containers are delivered in a frozen state, and therefore require the recipient of the container to maintain the frozen state of the container until they are ready for use. The container cannot be used in the juice machine unless and until the container is left to atmosphere in order to cause a thawing of the frozen juice whereupon the container may then be placed into the juice machine with the exit port positioned in an appropriate valve assembly so that the juice from the container may be dispensed when the valve is opened.

The one principal advantage that the containers containing the frozen juices have over the bag in box containers is the fact that any juices contained in such plastic containers may have frozen juices including the pulp. Various segments of the public have come to believe that juices containing the pulp of the juice is a healthier product for ingestion, and therefore there appears to be some desire that vended juices contain the pulp as well as the juice. One problem encountered in dispensing a pulp-containing fruit juice from a container is the valves are not designed to allow pulp to flow through the valve without the pulp ultimately plugging an exit port of the valve.

Another problem encountered in prior art juice containers, such as the one described in U.S. Pat. No. 6,561,386, is the closure assembly can be disassembled after filling of the container. This results from container manufacturers designing the bag to be shipped in an empty state to a filler operation where the closure assembly is automatically disassembled prior to filling and reassembled after filling by filling machinery. Such a design allows for tampering of the contents of the container which is undesirable.

SUMMARY OF THE INVENTION

The present invention provides a valve body for a liquid container. The valve body has a sidewall defining a fluid pathway having a liquid exit; a valve member positioned in the fluid pathway and moveable from a closed position where no liquid can flow through the fluid exit and an open position where fluid can flow through the fluid exit; a first docking member on the sidewall and dimensioned to releasably connect the body to an interior of a fitment to define a travel position; and a second docking member spaced from the first docking member on the sidewall and dimensioned for permanently connecting the body to a fitment.

The present invention further provides a closure assembly for a fluid container. The assembly has a fitment having a flange for connecting to a sidewall of the container, the fitment having an interior surface; a valve body having a sidewall defining a fluid pathway having a liquid exit; a first docking member on the sidewall and dimensioned to releasably connect the body to the interior surface of the fitment to define a travel position; and a second docking member spaced from the first docking member on the sidewall and dimensioned to permanently connect the body to the fitment.

These and other aspects and attributes of the present invention will be discussed with reference to the following drawings and accompanying specification.

DETAILED DESCRIPTION OF THE INVENTION

The present invention is susceptible of embodiments in many different forms. Preferred embodiments of the invention are disclosed with the understanding that the present disclosure is to be considered as exemplifications of the principles of the invention and are not intended to limit the broad aspects of the invention to the embodiments illustrated.

Figure 1:
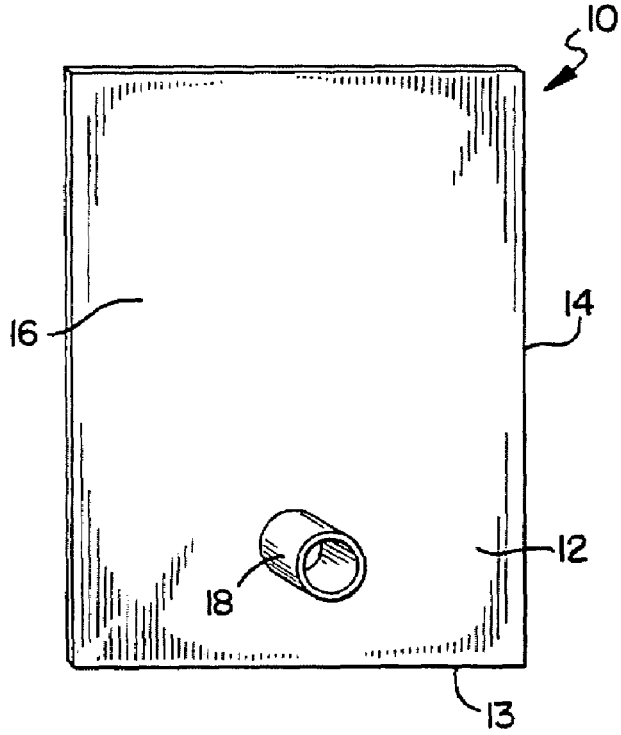
FIG. 1 is a perspective view of a container having a fitment.
Figure 2:
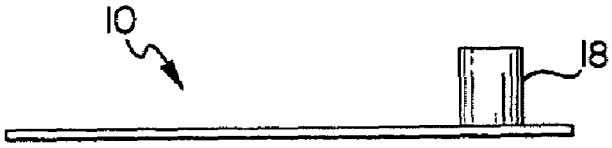
FIG. 2 is a side view of the container of FIG. 1.

FIGS. 1 and 2 show a flexible container assembly 10 having a first sidewall 12 and a second sidewall 13 attached at peripheral edges 14 to define a fluid tight chamber 16 and a fitment 18 for providing fluid access to the contents of the container. In a preferred form of the invention, the first and second sidewalls 12 and 13 are a flexible polymeric material having a modulus of elasticity of less than 50,000 psi. The sidewalls preferably are made from materials such as homopolymers and copolymers of polyolefins, polyamides, polyesters or other material that are capable of being sealed using industry standard sealing techniques. These techniques include, but are not limited to, heat sealing, radio frequency welding, and ultrasonic sealing. The sidewalls may be of a single web of material or multiple webs of material. Each web of material may be a multilayered or single layered and may be fabricated from any suitable polymer processing technology including extrusion, coextrusion, extrusion lamination, lamination or other. The container can be made from individual sheets placed in registration and sealed along the periphery 14 or can be made from a blown film process where only opposing ends of a tube need be sealed to complete the container 10.

Figure 3:
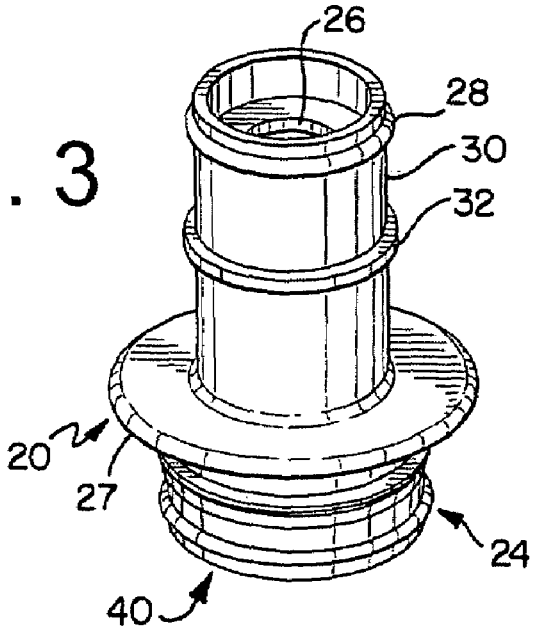
FIG. 3 is an isometric view of a valve body of the present invention.

FIG. 3 shows a valve body 20 having a first end 22 and a second end 24 and a fluid pathway 25 extending through the length of the valve body 20 terminating at the first end with a fluid exit 26. The valve body has a generally cylindrical shape having a first diameter portion d1, a second diameter portion d2 greater than d1 and a gripping flange 27 therebetween. As will be described in greater detail below, d1 is dimensioned to receive a spring and a ball for sealing and opening the fluid exit 26.

In a preferred form of the valve body 20, the first end 22 has a circumferentially extending sealing ring 28 integrally formed with the body 20. It is also contemplated utilizing an elastomeric sealing o-ring in place of the integral ring. However, it is preferred to use an integral ring in order to reduce the number of parts and to avoid the step of assembling the o-ring to the valve body. Although, the elastomeric ring would function in this capacity, it is less desirable from a cost standpoint. The sealing ring is provided to cooperate with a cap (not shown) that is dimensioned to be slid over an outer surface 30 of the valve body 20 to form a friction fit therewith.

An annular flange 30 is located intermediate of the first end 22 and the second end 24 for docking to equipment used to fill the container 10.

The second end of the container 24 has a portion 40 for docking with the fitment 18 on an interior portion thereof. The docking portion 40 has a first ring 42 proximal the flange 30, a second ring 44 axially spaced from the first ring 42 and a lead-in section 46 at an outermost end of the docking portion 40. The two first and second rings 42 and 44 provide two docking positions with the fitment. The first position is defined when only the second ring 44 is engaged in a complementary groove in an interior portion of the fitment. This position is known as the travel position and when in this position the valve body 20 can be separated from the fitment by filling machinery without damaging the valve body. The second position is known as the locked position and is reached when the valve body is inserted farther into the fitment wherein both the first and second rings 42 and 44 are engaged in complementary grooves located on an interior portion of the fitment. While in the locked position the valve body cannot be removed from the fitment without damaging or ruining the assembly for its intended purpose. The valve body is positioned in the locked position after filling of the container to deter tampering with the contents of the container.

Figure 4:
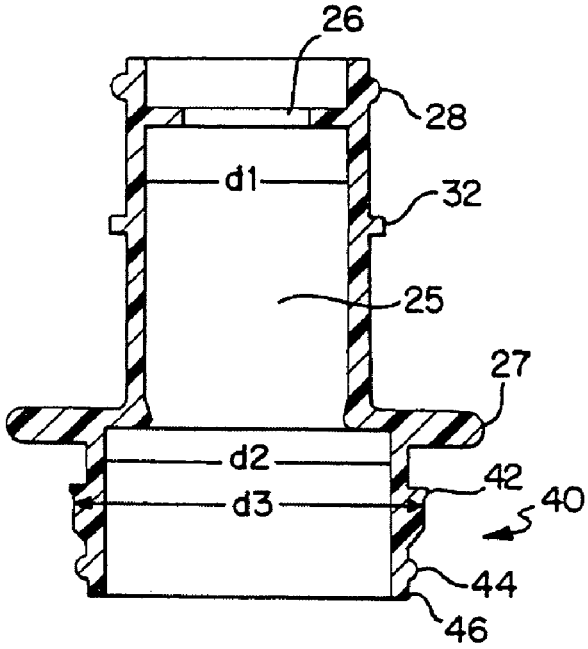
FIG. 4 is a cross-sectional view of the valve body of FIG. 3.
Figure 5:
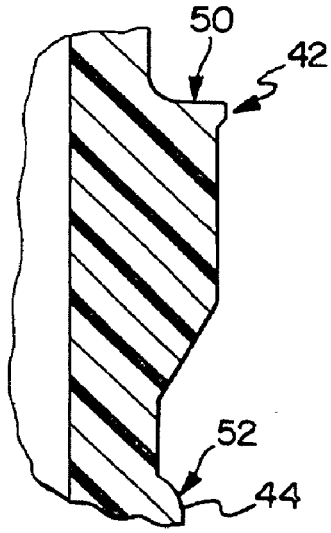
FIG. 5 is an enlarged view of a portion of the valve body having a pre-cap locking ring and a full cap locking ring.

FIGS. 4 and 5 show the first ring has a first outer diameter d3 and the second ring has a second outer diameter d4 wherein d3 is greater than d4. The first ring 42 has a generally flat surface 50 to provide a pronounced locking surface. The second ring 44 has a generally curved outer surface 52. The curved surface 52 and its reduced outer diameter d4 forms is capable of docking to a complementary groove with a removal force less than the removal force when the second ring is positioned in the same groove of the fitment.

The lead-in section 46 has a generally curved outer profile 55 that assists in guiding the valve body 20 into proper alignment with the fitment by the filling equipment or by hand assembly. One benefit realized by docking the valve body 20 to an interior surface of a fitment as opposed to having the docking section 40 docking to an outer surface of the fitment is that it reduces the number of closure assemblies that are damaged during the docking procedure due to slight misalignments of the valve body with the fitment.

The gripping flange 27 can be provided with texturing on one of its surfaces to assist users in handling of the valve body. In a preferred form of the gripping flange, a circumferential edge of the flange has a generally scalloped shaped cutouts. Of course different shaped cutouts could be used without departing from the scope of the invention. Further, texturing could be provided on a top surface, a bottom surface or both of the flange in addition to or in lieu of the texturing on the outer circumferential edge shown.

Figure 6:
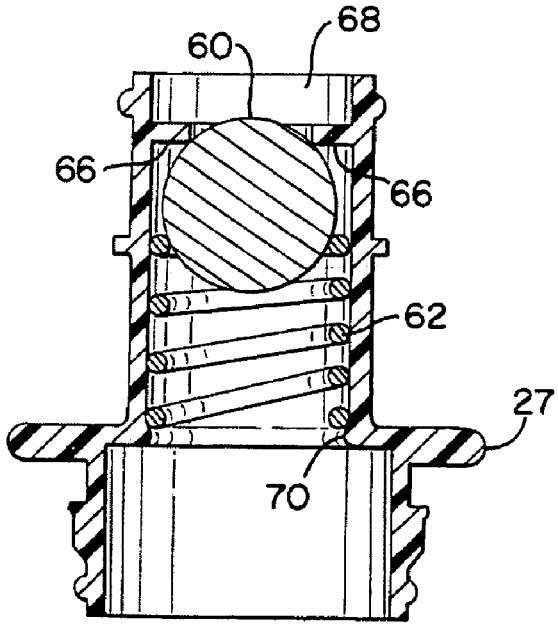
FIG. 6 is a cross-sectional view of the valve body of FIG. 4 with a spring-loaded ball mounted therein.
Figure 7:
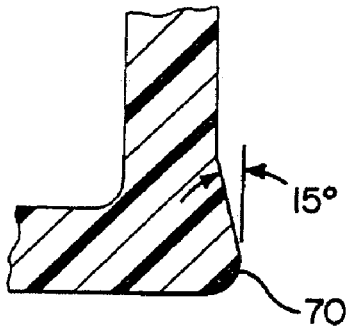
FIG. 7 is an enlarged view of a spring detent of the valve body.

FIG. 6 shows the valve body 20 with a ball 60 and a spring 62. The spring 62 urges the ball against a surface 66 to seal the fluid outlet 26. A portion of the ball extends through the fluid outlet into an annular space 68. The ball 60 is moved from the closed position shown in FIG. 6 to an open position wherein at least a portion of the ball is moved away from the surface 66 to allow fluid to pass through the gap created. The ball is moved from a closed to an open position by a user activating a fluid dispensing mechanism.

The spring 62 is positioned within the valve body 20 and protuberances 70 serve as a stop to ensure the spring is maintaining a load.

The ball and spring closure mechanism of the valve body could be replaced by other types of valves such as check valves, butterfly valves, duckbill valves, poppet type valves and the like.

While the specific embodiments have been described, numerous modifications come to mind without significantly departing from the spirit of the invention and the scope of protection is only limited by the scope of the accompanying claims. This design is just one example of a pattern design having these favorable characteristics, and disclosure of it is merely one example of a design having its favorable characteristics, others of which are not significant departures from the spirit of the invention.

What is claimed is:

1. A valve body for a liquid container adapted for use with a fitment comprising:

a valve body having a proximal end having a fluid inlet and a distal end having a fluid outlet and a generally cylindrical shaped wall having an outer surface and defining a fluid pathway between the fluid inlet and the fluid outlet;

a valve member positioned in the fluid pathway and moveable from a closed position where no liquid can flow through the fluid outlet to an open position where fluid can flow through the fluid outlet;

a first ring on the outer surface proximate the proximal end and having a first diameter and a generally rounded outer profile; and a second ring on the outer surface spaced axially inwardly from the first ring in a position between the first ring and the distal end, the second ring having a second diameter greater than the first diameter and having a generally flat surface facing the distal end, the first ring is dimensioned to releasably engage an interior surface of the fitment when inserted a first distance inside the fitment to define a first position, and the second ring is dimensioned to lock to the body when inserted a second distance inside the fitment to define a second position, the second distance being greater than the first distance.

2. The valve body according to claim 1, wherein the valve member further comprises a ball and spring assembly.

3. The valve body according to claim 2, wherein the valve body includes protuberances for supporting the spring.

4. The valve body according to claim 1, wherein the valve member is selected from the group consisting of ball check valves, butterfly valves, duckbill valves and poppet valves.

5. A closure assembly for a fluid container adapted for use with a fitment comprising:

a fitment having a flange for connecting to a sidewall of the container, the fitment having an interior surface;

a valve body having a proximal end having a fluid inlet and a distal end having a fluid outlet and a generally cylindrical shaped wall having an outer surface and defining a fluid pathway between the fluid inlet and the fluid outlet;

a valve member positioned in the fluid pathway and moveable from a closed position where no liquid can flow through the fluid outlet to an open position where fluid can flow through the fluid outlet;

a first ring on the outer surface proximate the proximal end and having a first diameter and a generally rounded outer profile; and a second ring on the outer surface spaced axially inwardly from the first ring in a position between the first ring and the distal end, the second ring having a second diameter greater than the first diameter and having a generally flat surface facing the distal end, the first ring is dimensioned to releasably engage the interior surface of the fitment when inserted a first distance inside the fitment to define a first position, and the second ring is dimensioned to lock to the body to the fitment when inserted a second distance inside the fitment to define a second position, the second distance being greater than the first distance.

* * * * *